US005496790A

United States Patent [19]

Ohno et al.

[11] Patent Number: 5,496,790

[45] Date of Patent: Mar. 5, 1996

[54] THERMAL TRANSFER IMAGE-RECEIVING SHEET

[75] Inventors: Akihiko Ohno; Takatoshi Nishizawa; Akira Iwai, all of Ibaraki, Japan

[73] Assignee: Oji Yuka Goseishi Co., Ltd., Tokyo, Japan

[21] Appl. No.: 264,363

[22] Filed: Jun. 23, 1994

[30] Foreign Application Priority Data

Jun. 23, 1993 [JP] Japan ..... 5-174628

[51] Int. Cl.[6] ..... B41M 5/035; B41M 5/38

[52] U.S. Cl. ..... 503/227; 428/195; 428/212; 428/318.6; 428/319.7; 428/319.9; 428/408; 428/910; 428/913; 428/914

[58] Field of Search ..... 8/471; 428/195, 428/408, 913, 914, 212, 318.6, 318.4, 319.3, 319.7, 319.9, 910; 503/227

[56] References Cited

FOREIGN PATENT DOCUMENTS 0439049 7/1991 European Pat. Off. ..... 503/227

0476508 3/1992 European Pat. Off. .

0522740 1/1993 European Pat. Off. ..... 503/227

*Primary Examiner*—B. Hamilton Hess

*Attorney, Agent, or Firm*—Sughrue, Mion, Zinn, Macpeak & Seas

[57] ABSTRACT

A thermal transfer image-receiving sheet having (1) a support of (B) a base layer which is a biaxially stretched microporous film of a thermoplastic resin containing from 10 to 45% by weight of an inorganic fine powder and (A) a surface layer which is a biaxially stretched film of a thermoplastic resin having a three-dimensional center-plane average roughness (Ra) of not more than 0.5 μm, surface layer (A) having a spatial average wavelength (λa), defined by the equation $\lambda a=2\pi Ra/\Delta a$, where Ra is the three-dimensional center-plane average roughness and $S\Delta a$ is the three-dimensional average slope, of not more than 100 μm and a gloss of not less than 93% as measured at 75° according to JIS P-8142 and (2) an image-receiving layer provided on the surface of the surface layer (A). The image-receiving sheet provides a clear image having high density, high gloss, and reduced rough feeling even using reduced printing energy.

8 Claims, 2 Drawing Sheets

THERMAL TRANSFER IMAGE-RECEIVING SHEET

FIELD OF THE INVENTION

The present invention relates to a thermal transfer image-receiving sheet and more particularly to a thermal transfer image-receiving sheet on which a clear dye image having high density, high gloss and little rough feeling can be formed, even using reduced printing energy.

BACKGROUND OF THE INVENTION

Thermal transfer recording is generally carried out by heating a thermal transfer recording material, called an ink ribbon, which comprises a support having thereon a color forming layer containing a sublimable or vaporizable dye to sublimate or vaporize the dye and then transferring the dye to an image-receiving sheet to form a dye image.

More specifically, as shown in FIG. 3, thermal transfer recording material 1 composed of support 4 and color forming layer 5 and image-receiving sheet 2 composed of thermal transfer image-receiving layer 6 and support 7 are brought into contact between drum 12 and electrically controlled heating source 3, and color forming layer 5 of transfer recording material 1 is heated by means of heat source 3, such as a thermal head, to sublimate or vaporize the dye contained in color forming layer 5. The sublimated or vaporized dye is thus transferred to image-receiving layer 6 to achieve thermal transfer recording.

The material constituting image-receiving layer 6 depends on the kind of the color former (dye) to be transferred thereto. For example, if one uses a heat-fusible color former, support 7 by itself can serve as an image-receiving layer. If one uses a sublimable disperse dye as a color former, a coated layer comprising a high polymer, such as a polyester, may be used as an image-receiving layer.

Support 7 of image-receiving sheet 2 typically will be a pulp paper, an opaque synthetic paper comprising a stretched film of a propylene-based resin containing an inorganic fine powder (see JP-B-46-40794 (corresponding to U.S. Pat. No. 4,318,950), the term "JP-B" as used herein means an "examined published Japanese patent application"), or a coated synthetic paper prepared by coating a transparent polyethylene terephthalate or polyolefin film with a layer of a binder containing an inorganic Compound, such as silica or calcium carbonate, to impart whiteness and dye-receptivity thereto.

Considering the after-use properties of an image-receiving sheet with a transferred dye image with respect to, for example, suitability for copying, writability with a pencil, and record preservability, a synthetic paper comprising a microvoid-containing stretched film of a polyolefin resin containing an inorganic fine powder is preferred as a support from the standpoint of strength, dimensional stability, and contact with a printing head, as disclosed in JP-A-60-245593, JP-A-61-112693 and JP-A-63- 193836 (the term "JP-A" as used herein means an "unexamined published Japanese patent application").

In this type of synthetic paper, microvoids are formed by stretching an inorganic fine powder-containing polyolefin resin film at a temperature lower than the melting point of the polyolefin resin so as to provide opacity, softness to the touch, intimate contact with a printing head, and smoothness in paper feed or discharge.

In recent years, a demand has arisen for thermal transfer image-receiving sheets with high surface gloss. In order to increase gloss, it is desirable to use a synthetic paper having a surface layer containing substantially no inorganic filler. However, even if an image-receiving sheet itself has gloss, if the support thereof has a rough feeling due to surface unevenness, the glossy feeling of a transferred image will be impaired.

Further, with the latest rapid advances in the speed of printing with a thermal transfer recording apparatus, the industry has demanded images of high density with satisfactory gradation even with a narrowed pulse width, particularly with a thermal transfer image-receiving sheet capable of multiple transfer as disclosed in JP-A-63-222891.

It is a common knowledge in the art that printing density can be increased by increasing the surface smoothness of an image-receiving sheet. If the compounding ratio of inorganic fine powder is reduced in an attempt to increase the surface smoothness of a synthetic paper support, the voids formed by stretching will be reduced in number, resulting in a reduction in the cushioning effect of the support. It follows that image density is then reduced as is established in Comparative Example 1 of JP-A-63-222891 supra.

SUMMARY OF THE INVENTION

An object of the present invention is to provide a thermal transfer image-receiving sheet comprising a support having excellent surface smoothness while retaining a sufficient cushioning effect, whereby one can form an image thereon having high density even when using high-speed printing.

The present inventors conducted extensive investigations on synthetic paper composed of a base layer comprising a biaxially stretched microporous resin film prepared from a thermoplastic resin containing an inorganic fine powder, which film has thereon a surface layer comprising a thermoplastic resin film having a three-dimensional center-plane average roughness (Ra; measured according to JIS B-0601) of not more than 0.5 μm. As a result, the inventors found that there is a correlation between the spatial average wavelength ($\lambda a$; measured according to JIS B-0601), which is defined by the equation: $\lambda a=2\pi Ra/\Delta a$ (wherein Ra is the three-dimensional center-plane average roughness and $\Delta a$ is the three-dimensional average slope), and rough feeling. As a result of further study, it was found that an image of high gloss can be formed and any rough feeling due to small surface unevenness can be reduced by using a support having a spatial average wavelength of not more than 100 μm and a gloss of not less than 93% measured according to JIS P-8142 (at 75°). The present invention was completed based on this finding.

The present invention provides a thermal transfer image-receiving sheet comprising (1) a support composed of (B) a base layer comprising a biaxially stretched microporous film of a thermoplastic resin containing from 10 to 45% by weight of an inorganic fine powder based on the total weight of the resin and the fine powder and (A) a surface layer comprising a biaxially stretched film of a thermoplastic resin having a three-dimensional Center-plane average roughness (Ra) of not more than 0.5 μm and preferably from 0.25 to 0.45 μm, the surface layer (A) having a spatial average wavelength ($\lambda a$), defined by the equation: $\lambda a= 2\pi Ra/\Delta a$ (where Ra is the three-dimensional center-plane average roughness; and $\Delta a$ is the three-dimensional average slope), of not more than 100 μm and preferably from 60 to 75 μm, and a gloss of not less than 93% and preferably from 93 to 120% measured at 75° according to JIS P-8142 and (2) an image-receiving layer provided on the surface of surface layer (A).

DETAILED DESCRIPTION OF THE INVENTION

Figure 1:
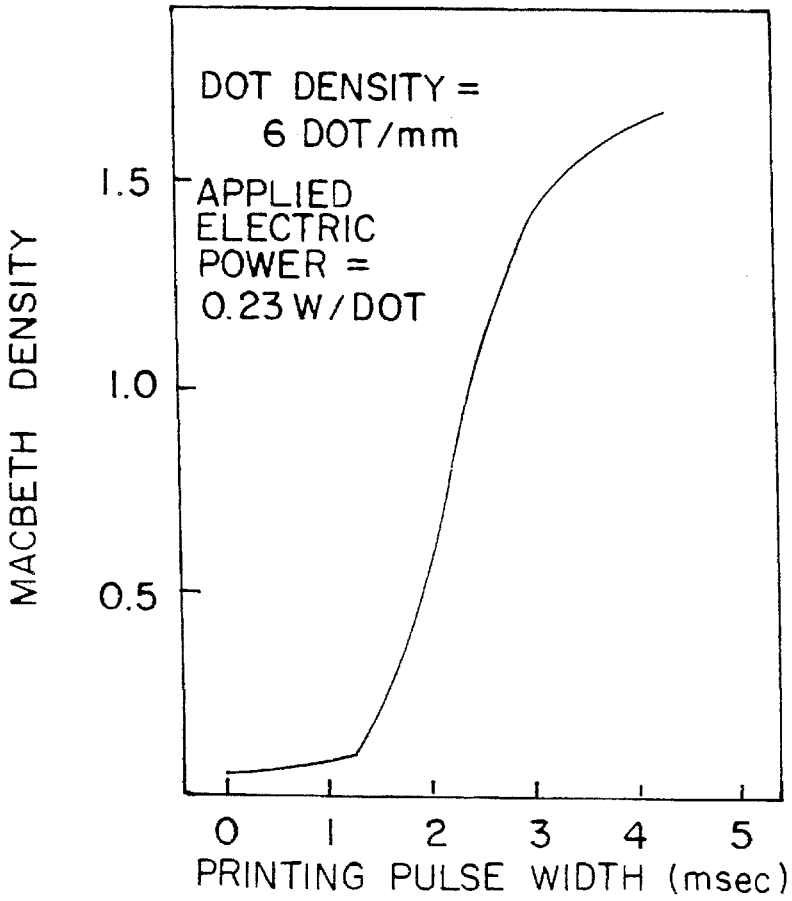
FIG. 1 is a graph of the Macbeth density of the transferred image obtained vs. the printing pulse width used in Example 1.

The thermoplastic resin which can used in both base layer (B) and surface layer (A) of support (1) includes polyolefins, such as polyethylene, polypropylene, an ethylene-propylene copolymer, an ethylene-vinyl acetate copolymer, a propylene-butene-1 copolymer, poly(4-methylpentene- 1), and polystyrene; polyamides, such as nylon 6 and nylon 6.6; and polyesters, such as polyethylene terephthalate and polybutylene phthalate. From the standpoint of cost and gloss, propylene-based resins are preferred, such as a propylene homopolymer, an ethylene-propylene random copolymer having an ethylene content of from 0.5 to 8% by weight, and an ethylene-propylene-butene-1 random copolymer having an ethylene content of from 0.5 to 8% by weight, a butene-1 content of from 4 to 12% by weight, and a propylene content of from 80 to 95.5% by weight.

The inorganic fine powder which is incorporated into the thermoplastic resin of the base layer in order to form microvoids inside the thermoplastic resin film formed therefrom includes powders of calcium carbonate, calcined clay, diatomaceous earth, talc, titanium oxide, barium sulfate, aluminum sulfate or silica. To insure that the support will have a three-dimensional center-plane average roughness (Ra) of not more than 0.5 μm, the inorganic powder preferably has an average particle size of not greater than 3 μm and preferably from 0.01 to 2.0 μm.

Figure 2:
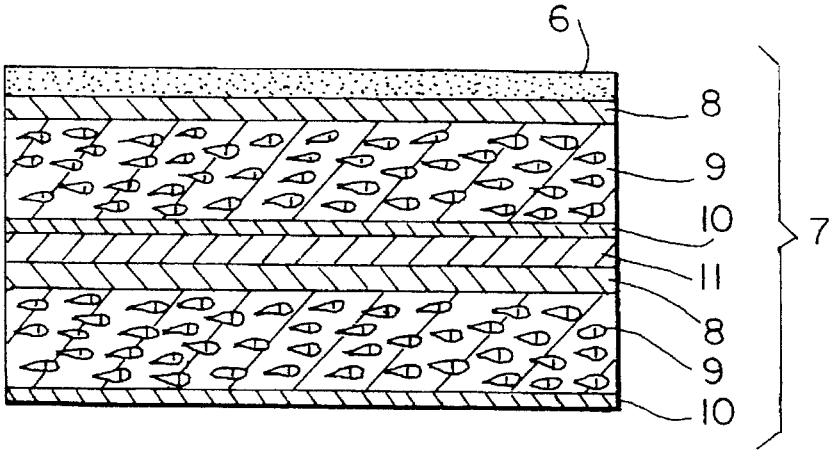
FIG. 2 is a schematic cross section illustrating an example of the thermal transfer image-receiving sheet according to the present invention.
Figure 3:
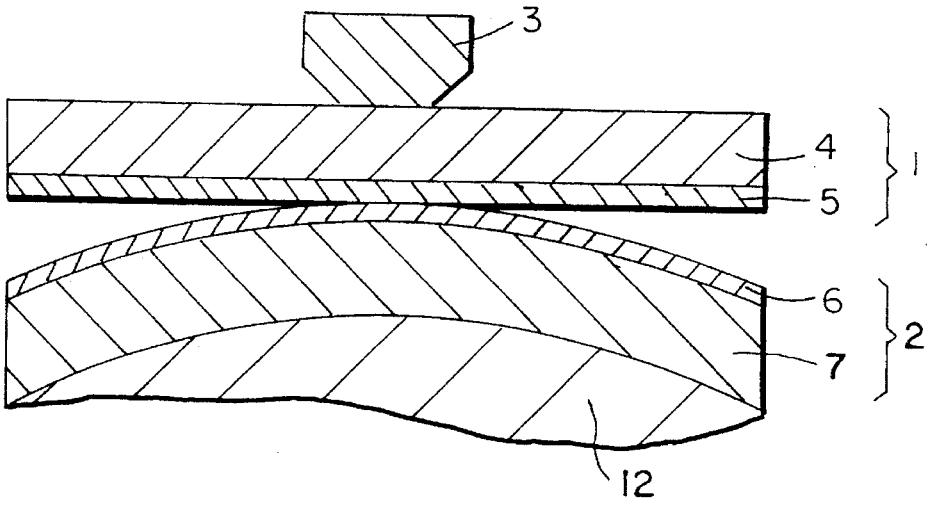
FIG. 3 (PRIOR ART)
FIG. 3 is a schematic view illustrating a thermal transfer recording system.

If desired, in addition to base layer (B) and surface layer (A), the support of the present invention may have a backing layer having a thickness of from 5 to 120 μm comprising, for example, pulp paper or a polyethylene terephthalate film to inhibit a curl, or a back surface layer comprising a uniaxially stretched film of polypropylene containing from 8 to 55% by weight of an inorganic fine powder to impart a pencil writability thereon. For example, support 7 shown in FIG. 2 comprises a pair of laminate films, adhered with pulp paper 11 as an intermediate backing layer to inhibit a curl, the laminate films each having a three-layered structure composed of surface layer 8 comprising a biaxially stretched propylene-based resin, base layer 9 comprising a biaxially stretched microporous film of an inorganic fine powder-containing propylene-based resin, and back surface layer 10 comprising a uniaxially stretched inorganic fine powder-containing propylene-based resin film. Image-receiving layer 6 is formed on one of surface layers 8 to provide thermal transfer image-receiving sheet 2 according to one embodiment of the present invention.

Surface layer (A) of the support preferably has a thickness exceeding 1.5 μm, and still more preferably of from 2 to 10 μm, to provide high gloss.

The support of the present invention is prepared by melt-kneading a thermoplastic resin containing no inorganic fine powder and a thermoplastic resin containing from 10 to 45% by weight of an inorganic fine powder in separate extruders, feeding the molten resins to a co-extrusion die, extruding the molten laminate into a laminate film through the die, cooling the laminate film to a temperature lower than the melting point of the thermoplastic resin to form a base layer by 30° to 100° C., re-heating the laminate film to a temperature in the vicinity of the melting point, and stretching the laminate 3 to 8 times in the machine direction and 3 to 12 times in the transverse direction, the stretching either simultaneously or successively.

The support may also be obtained by preparing a biaxially stretched film of a thermoplastic resin containing no inorganic fine powder and a biaxially stretched film of a thermoplastic resin containing from 10 to 45% by weight of an inorganic fine powder based on the total weight of the resin and the fine powder by using separate extruders and separate stretching machines and then laminating the two stretched films together with an adhesive such as a mixture of polyether polyol or polyester polyol and polyisocyanate. Even when the separate stretching machines are used, the same degree of stretching as described above apply.

Surface layer (A) of the support, on which image-receiving layer 6 is to be provided, has a three-dimensional center-plane average roughness (Ra) of not more than 0.5 μm, and preferably from 0.30 to 0.45 μm, a spatial average wavelength (λa) of not more than 100 μm, and preferably from 55 to 75 μm, and a gloss of not less than 93%. A support whose surface layer satisfies these conditions exhibits its suitability for high-speed printing and provides a high gloss image with no rough feeling.

Base layer (B) contains inorganic fine particles and microvoids formed therearound on stretching to provide the support with a satisfactory cushioning effect, so that the image-receiving sheet can be brought into intimate contact with a color forming layer and an image of high density can be transferred to the image-receiving sheet.

Surface layer (A) of the support preferably has a Bekk's index (measured according to JIS P-8119) of from 11,000 to 20,000 seconds. The higher the Bekk's index, the higher the color density attained and the greater the suitability for high-speed printing. The support preferably has an opacity (measured according to JIS P-8138) of 70% or more. The higher the opacity, the higher the image contrast and the visual image. Semi-transparency (i.e., an opacity of from 40 to 65%) is preferred for some end uses.

The density and compressibility of a support are correlated with each other. As void volume increases, the density decreases and the compressibility increases. The void volume (V; %) of the support ranges preferably from 15 to 60%, and more preferably from 18 to 45%, as calculated according to the equation:

$$V = \frac{\rho_0 - \rho}{\rho_0} \times 100\ (\%)$$

wherein $\rho_O$ is the density of the unstretched film; and $\rho$ is the density of the stretched film.

As the density (measured according to JIS P-8118) of the support decreases with increasing compressibility, the image-receiving sheet exhibits more excellent contact with a thermal head to form a clear image.

The support has a density of not more than 0.78 g/cm$^3$, preferably not less than 0.55 g/cm$^3$ but less than 0.70 g/cm$^3$, and a compressibility of from 36 to 55%, preferably from 38 to 50%, under a compression load of 32 kg/cm$^2$. A support satisfying these conditions exhibits excellent suitability for high-speed printing, that is, provides a clear image of high density and provides high sensitivity even using a low printing energy.

A thermal transfer image-receiving layer is provided on surface layer (A) of the support to provide a thermal transfer image-receiving sheet according to the present invention.

Materials for forming such a thermal transfer image-receiving layer preferably include polymers, such as acrylic resins and polyolefin resins, which are particularly suited for receiving heat-fusible color formers containing a pigment; and polymers, such as polyesters, and clay, which are particularly suitable for dyeing with sublimable or vaporizable dyes (see U.S. Pat. Nos. 4,778,782, 4,971,950 and 4,999,335).

Preferred of these materials are acrylic resins, including (a) an acrylic copolymer resin, (b) a mixture of (1) an acrylic copolymer resin, (2) a polyamine, and (3) an epoxy resin, and (c) a mixture of (a) or (b) and an inorganic or organic filler.

Monomers constituting the acrylic copolymer resins as (a) or component (1) in (b) include dimethylaminoethyl methacrylate, diethylaminoethyl methacrylate, dibutylaminoethyl acrylate, dimethylaminoethyl acrylamide, diethylaminoethyl methacrylamide, and dimethylaminoethyl methacrylamide.

Other vinyl monomers constituting the acrylic copolymer resins include styrene, methyl methacrylate, ethyl acrylate, n-butyl acrylate, t-butyl acrylate, ethyl methacrylate, vinyl chloride, ethylene, acrylic acid, methacrylic acid, itaconic acid, acrylonitrile, and methacrylamide.

Polyamines useful as a component in (b) include polyalkylenepolyamines, e.g., diethylenetriamine and triethylenetetramine, polyethyleneimine, ethyleneurea, an epichlorohydrin adduct of a polyamine-polyamide (e.g., "Kymene-557H" produced by Dick-Hercules and "AF-100" produced by Arakawa Rinsan Kagaku Kogyo K.K.), and an aromatic glycidyl ether or ester adduct of polyamine-polyamide (e.g., "Sanmide 352", "Sanmide 351" and "X-2300-75" all produced by Sanwa Kagaku K.K., and "Epicure-3255" produced by Shell Kagaku K.K.).

Epoxy resins useful as a component in (b) include bisphenol A diglycidyl ether, bisphenol F diglycidyl ether, phthalic acid diglycidyl ester, polypropylene glycol diglycidyl ether, and trimethylolpropane triglycidyl ether.

Inorganic fillers useful as a component in (c) include synthetic silica (e.g., white carbon) and inorganic pigments, such as calcium carbonate, clay, talc, aluminum sulfate, titanium dioxide, and zinc oxide, each having an average particle size of not more than 0.5 μm, preferably from 0.01 to 0.2 μm. Preferred of these are synthetic silica (e.g., white carbon) and ground calcium carbonate having an average particle size of not more than 0.2 μm.

Organic fillers as a component in (c) include fine particles of various polymers preferably having a particle diameter of not more than 10 μm. The polymers include methyl cellulose, ethyl cellulose, polystyrene, polyurethane, urea-formaldehyde resins, melamine resins, phenolic resins, iso-(or diiso-)butylene/maleic anhydride copolymers, styrene/maleic anhydride copolymers, polyvinyl acetate, polyvinyl chloride, vinyl chloride/vinyl acetate copolymers, polyesters, polyacrylic esters, polymethacrylic esters, and styrene/butadiene/acrylate copolymers.

The inorganic filler may be subjected to a surface treatment with a nonionic, cationic or amphoteric surface active agent, such as Turkey red oil (sulfonated oil), sodium dodecylsulfate, organic amines, metallic soaps or sodium lignin sulfonate, so as to have improved wettability by the inks of the thermal transfer recording material.

These fillers are usually used in a proportion of not more than 30% by weight and preferably from 0 to 15% by weight.

A mixed resin of a saturated polyester and a vinyl chloride-vinyl acetate copolymer can also used as a material to form the image-receiving layer. The saturated polyester includes "Vylon 200, 290 or 600" produced by Toyobo Co., Ltd., "KA-1038C" produced by Arakawa Kagaku K.K., and "TP 220 or 235" produced by Nippon Gosei K.K.). The vinyl chloride-vinyl acetate copolymer preferably has a vinyl chloride content of from 85 to 97% by weight and a degree of polymerization of from about 200 to 800. The vinyl chloride-vinyl acetate copolymer may further comprise a vinyl alcohol unit, a maleic acid unit, etc. Examples of useful vinyl chloride-vinyl acetate copolymers include "S-Lec A, C or M" produced by Sekisui Chemical Co., Ltd., "Vinylite VAGH, VYHH, VMCH, VYHD, VYLF, VYNS, VMCC, VMCA, VAGD, VERR or VROH" produced by Union Carbide Corp., and "Denka Vinyl 1000GKT, 1000L, 1000CK, 1000A, 1000LK$_2$, 1000AS, 1000MT$_2$, 1000CSK, 1000CS, 1000GK, 1000GSK, 1000GS, 1000LT$_2$, 1000D or 1000W" produced by Denki Kagaku Kogyo K.K. A preferred mixing ratio of the (a) saturated polyester to the (b) vinyl chloride-vinyl acetate copolymer is 100 to 900 parts by weight of (a):100 parts by weight of (b).

The material forming the thermal transfer image-receiving layer is coated on the surface layer 8 of the support by means of a general coating machine, e.g., a blade coater, an air knife coater, a roll coater, and a bar coater, or a size press, a gate roll machine, etc., and dried at 30° to 50° C. to form a thermal transfer image-receiving layer having a thickness of from 0.2 to 20 μm, and preferably of from 0.5 to 10 μm.

If desired, the resulting thermal transfer image-receiving sheet may be subjected to calendering to further improve surface smoothness.

The present invention will now be illustrated in greater detail with reference to Examples, but it should be understood that the present invention is not limited thereto. All the percents, parts, and ratios are given by weight unless otherwise indicated.

Measurement of Physical Properties of Support

Physical properties of the supports prepared were measured as follows.

1) Compressibility

Compressibility under a compression load of 32 kg/cm$^2$ was obtained from the equation:

$$\text{Compressibility (\%)} = \frac{\text{Compressive strain (μm)}}{\text{Thickness of Specimen (μm)}} \times 100$$

2) Three-dimensional Center-plane Average Roughness (Ra)

Measured in accordance with JIS B 0601-1982 by means of a three-dimensional roughness meter "SE-3AK" manufactured by Kosaka Kenkyusho and an analyzer "Model SPA-11".

3) Spatial Average Wavelength (λa)

Measured in accordance with JIS B 0601-1982 by means of a three-dimensional roughness meter "SE-3AK" manufactured by Kosaka Kenkyusho and an analyzer "Model SPA-11".

Preparation of Support (A) An ethylene-propylene random copolymer (ethylene content: 2.6%) having a melt index (MI) of 4 g/10 min and a melting point of about 154° C., (B) a composition comprising 65 parts of an ethylene-propylene random copolymer (ethylene content: 2.3%) having an MI of 0.8 g/10 min and a melting point of about 156° C., 10 parts of high-density polyethylene having an MI of 1.2 g/10 min and a melting point of about 134° C., and 25 parts of calcium carbonate having an average particle size of 1.5 μm, and (C) the same ethylene-propylene random copolymer as (A) above (MI: 4 g/10 min) were each melt-kneaded at 250° C. in separate extruders, fed to the same die, laminated in the die, and co-extruded into a sheet. The extruded sheet was cooled with a cooling roll to about 60° C. to obtain a laminate sheet.

The laminate sheet was heated to 145° C. and stretched 5 times in the machine direction using the difference in peripheral speed among plural rolls. The stretched film was again heated to about 150° C. and stretched 8.5 times in the transverse direction by means of a tenter. The resulting biaxially stretched film was subjected to annealing at 160° C., followed by cooling to 60° C. Both edges of the film were trimmed to obtain a support having a three-layered structure (A/B/C=3 μm/54 μm/3 μm). This support was designated S-1.

Surface layer A of support S-1 had a Bekk's index (measured according to JIS P-8119) of 12,800 sec, a three-dimensional center-plane average roughness (Ra) of 0.42 μm, a gloss of 93%, and a spatial average wavelength (λa) of 65.3 μm. Support S-1 had an opacity of 84%, a density of 0.72 g/cm$^3$, a void volume of 26%, and a compressibility of 28% under a load of 32 kg/cm$^2$.

MI of 4 g/10 min and a melting point of 164° C. were each melt-kneaded at 260° C. in separate extruders, fed to the same die, laminated in the die, and extruded into a sheet at 250° C. The extruded sheet was cooled with a cooling roll to about 60° C. to obtain a laminate sheet.

The laminate sheet was heated to 150° C. and stretched 5.5 times in the machine direction using the difference in peripheral speed among plural rolls. The stretched film was again heated to about 162° C. and stretched 8 times in the transverse direction by means of a tenter. The resulting biaxially stretched film was subjected to annealing at 165° C., cooled to 60° C., and trimmed to obtain support S-7 having a three-layered structure (A/B/C=4 μm/52 μm/4 μm).

Surface layer A of support S-7 had a Bekk's index of 14,000 sec, a three-dimensional center-plane average roughness (Ra) of 0.40 μm, a gloss of 95% (at 75°), and a spatial average wavelength (λa) of 60.2 μm. Support S-7 had an opacity of 78%, a density of 0.73 g/cm$^3$, a void volume of 23%, and a compressibility of 23% under a load of 32 kg/cm$^2$.

For comparison, a comparative support was prepared in accordance with Example 1 of JP-A-61-3748.

The structure and physical properties of the resulting supports are tabulated in Table 1. In the Table, PP and HDPE stand for a propylene-based resin and high-density polyethylene, respectively (hereinafter the same).

TABLE 1

| Support | Surface Layer | Base Layer B | | | Back Layer C | | Thickness (A/B/C) | Properties of Surface Layer A | | | | Properties of Support | | |
|---|---|---|---|---|---|---|---|---|---|---|---|---|---|---|
| | | | | | | | | | | | | | Compressibility | |
| No. | A; PP | PP | HDPE | $CaCO_3$ | PP | $CaCO_3$ | (μm) | Ra (μm) | Gloss (%) | λa (μm) | Bekk's Index (sec) | Opacity (%) | (%) | Density (g/cm$^3$) |
| S-1 | 100 | 65 | 10 | 25 | 100 | — | 3/54/3 | 0.42 | 93 | 65.3 | 12800 | 84 | 28 | 0.72 |
| S-2 | 100 | 65 | 10 | 25 | 100 | — | 10/40/10 | 0.30 | 96 | 61.8 | 18300 | 83 | 27 | 0.71 |
| S-3 | 100 | 65 | 10 | 25 | 100 | — | 3/54/3 | 0.43 | 94 | 63.5 | 14600 | 87 | 35 | 0.60 |
| S-4 | 100 | 65 | 10 | 25 | — | — | 3/57/— | 0.40 | 93 | 65.8 | 13200 | 84 | 28 | 0.72 |
| S-5 | 100 | 65 | 10 | 25 (clay) | 100 | — | 3/54/3 | 0.44 | 93 | 72.1 | 11700 | 84 | 28 | 0.70 |
| S-6 | 100 | 65 | 10 | 25 | 60 | 40 | 3/54/3 | 0.42 | 94 | 66.5 | 13300 | 85 | 28 | 0.72 |
| Compar. Support | | Example 1 of JP-A-61-3748 | | | | | 5/25/90/25/5 | 0.28 | 92 | 110.5 | 10000 | 89 | 25 | 0.79 |
| S-7 | 100 | 73 | 5 | 22 | 100 | — | 4/52/4 | 0.40 | 95 | 60.2 | 15200 | 78 | 23 | 0.73 |

Support S-2, S-3 and S-6 having the physical properties shown in Table 1 below were prepared in the same manner as for support S-1, except for changing the composition of each layer and the die aperture.

Support S-4 having the physical properties shown in Table 1 was prepared in the same manner as for support S-1, except for excluding layer (C).

Support S-5 having the physical properties shown in Table 1 was prepared in the same manner as for support S-1, except for replacing calcium carbonate with calcined clay having an average particle size of 0.8 μm.

Support S-7 was prepared as follows. (A) A polypropylene having an MI of 4 g/10 min and a melting point of from 164° to 167° C., (B) a composition comprising 73 parts of polypropylene having an MI of 0.8 g/10 min and a melting point of 167° C., 5 parts of the high-density polyethylene having an MI of 1.2 g/10 min and a melting point of 134° C., and 22 parts of calcium carbonate having an average particle size of 1.5 μm, and (C) a polypropylene having an

EXAMPLES 1 TO 7 AND COMPARATIVE EXAMPLE 1

A thermal transfer image-receiving coating composition having the following formulation was applied on surface layer A of each of supports S-1 to S-7 and the comparative support by means of a wire bar coater to a dry thickness of 4 μm and dried at 80° C. for 3 seconds to obtain an image-receiving sheet.

Coating Composition Formulation

| | |
|---|---|
| Saturated Polyester: | |
| "Vylon 200" produced by Toyobo Co., Ltd.; Tg: 67° C. | 5.3 parts |
| "Vylon 290" produced by Toyobo Co., Ltd.; Tg: 77° C. | 5.3 parts |
| Vinyl chloride-vinyl acetate copolymer | 4.5 parts |

-continued

| | |
|---|---|
| ("Vinylite VYHH" produced by Union Carbide Corp.) | |
| Titanium oxide ("KA-10" produced by Titan Kogyo K.K.) | 1.5 parts |
| Amino-modified silicone oil ("KF-393" produced by Shin-Etsu Silicone Co., Ltd.) | 1.1 parts |
| Epoxy-modified silicone oil ("X-22-343" produced by Shin-Etsu Silicone Co., Ltd.) | 1.1 parts |
| Toluene | 30 parts |
| Methyl ethyl ketone | 30 parts |
| Cyclohexane | 22 parts |

The rough feeling of the surface of the resulting image-receiving sheet was visually evaluated according to the following rating system.

5 . . . Very good
4 . . . Good
3 . . . Not a problem for practical use
2 . . . Interferes with practical use
1 . . . Poor Further, the image-receiving sheet was printed using a printer produced by Ohkura Electric Co., Ltd. (dot density: 6 dot/mm; applied electric power: 0.23 W/dot) while varying the printing pulse width, and the gradation of the resulting image was visually evaluated according to the following rating system.

5 . . . Very good
4 . . . Good
3 . . . Not a problem for practical use
2 . . . Interferes with practical use
1 . . . Poor The Macbeth density of the transferred image on the image-receiving sheet was measured. The change of the density with the change of the pulse width is shown in FIG. 1.

The results of the evaluation are shown in Table 2.

TABLE 2

| Example No. | Support No. | Rough Feeling | Gradation |
|---|---|---|---|
| 1 | S-1 | 5 | 4 |
| 2 | S-2 | 5 | 4 |
| 3 | S-3 | 4 | 5 |
| 4 | S-4 | 4 | 4 |
| 5 | S-5 | 4 | 4 |
| 6 | S-6 | 4 | 4 |
| 7 | S-7 | 5 | 4 |
| Compar. Example 1 | Compar. Support | 2 | 4 |

EXAMPLE 8

(A) The ethylene-propylene random copolymer (ethylene content: 2.6%) having an MI of 4 g/10 min and a melting point of about 154° C., (B) a composition comprising 65 parts of the ethylene-propylene random copolymer (ethylene content: 2.3%) having an MI of 0.8 g/10 min and a melting point of about 156° C., 10 parts of the high-density polyethylene having an MI of 1.2 g/10 min and a melting point of about 134° C., and 25 parts of calcium carbonate having an average particle size of 1.5 μm, and (C) the ethylene-propylene random copolymer (ethylene content: 2.6%) having an MI of 4 g/10 min were each melt-kneaded in separate extruders at 250° C., fed to the same die, extruded into a sheet, and cooled to about 60° C. The extruded sheet was heated to 145° C. and stretched 5 times in the machine direction to obtain a three-layered stretched film.

(D) A composition comprising 55 parts of the ethylene-propylene random copolymer (ethylene content: 2.6%) having an MI of 4 g/10 min and 45 parts of calcium carbonate having an average particle size of 1.5 μm was melt-kneaded at 250° C. in an extruder and extruded into a sheet. The extruded sheet D was laminated on back surface layer C of the above-prepared 3-layered stretched sheet, followed by cooling to 60° C. The laminate sheet was re-heated to 150° C., transversely stretched 8.5 times by means of a tenter, subjected to annealing at 160° C., and cooled to 60° C., followed by trimming to obtain a stretched support having a 4-layered structure (A/B/C/D=3 μm/54 μm/3 μm/20 μm). The resulting support was designated support S-8.

Layer A of support S-8 had a Bekk's index of 12,600 sec, a three-dimensional center-plane roughness (Ra) of 0.43 μm, a gloss of 93%, and a spatial average wavelength (λa) of 75.9 μm. Support S-8 had an opacity of 87%, a density of 0.74 g/cm$^3$, a void volume of 24%, and a compressibility of 26% under a load of 32 kg/cm$^2$.

A thermal transfer image-receiving layer made from the coating composition having the same formulation as in the foregoing Examples was formed on layer A of support S-8 to prepare a thermal transfer image-receiving sheet. The resulting image-receiving sheet was evaluated in the same manner as in the foregoing Examples. As a result, it had a rough feeling rated 4 and a gradation rated 4.

EXAMPLE 9

(A) The ethylene-propylene random copolymer (ethylene content: 2.6%) having an MI of 4 g/10 min was melt-kneaded in an extruder at 250° C., extruded into a sheet, and cooled with a cooling roll to about 60° C. The sheet was heated to 145° C. and stretched 5 times in the machine direction and then stretched 8.5 times in the transverse direction at 162° C., followed by trimming to obtain a 20 μm thick biaxially stretched film (A).

(B) A composition comprising 65 parts of the ethylene-propylene random copolymer (ethylene content: 2.6%) having an MI of 4 g/10 min, 10 parts of the high-density polyethylene, and 25 parts of calcium carbonate having an average particle size of 1.5 μm was melt-kneaded in an extruder at 250° C., extruded into a sheet, and cooled with a cooling roll to about 60° C. The extruded sheet was heated at 145° C. and stretched 5 times in the machine direction and then 8.5 times transversely at 152° C., followed by trimming to obtain a 60 μm thick biaxially stretched film (B).

The resulting two stretched films (A) and (B) were bonded with an adhesive to prepare a support (designated support S-9) having a double layer structure (A/B= 20 μm/60 μm).

Surface layer A of support S-9 had a Bekk's index of 13,400 seconds, a three-dimensional center-plane average roughness (Ra) of 0.30 μm, a gloss of 97%, and a spatial average wavelength (λa) of 58.5 μm. Support S-9 had an opacity of 74%, a density of 0.83 g/cm$^3$, a void volume of 21%, and a compressibility of 20% under a load of 32 kg/cm$^2$.

A thermal transfer image-receiving layer made from the coating composition having the same formulation as in the foregoing Examples was formed on surface layer A of support S-9 to prepare a thermal transfer image-receiving sheet. The resulting image-receiving sheet was evaluated in the same manner as in the foregoing Examples. As a result, it had a rough feeling rated 4 and a gradation rated 4.

EXAMPLE 10

Support S-1 was laminated on each side of 60 μm thick fine pulp paper using a polyether polyol/polyisocyanate adhesive, with each layer A outermost to prepare a support having a 7-layered structure (A/B/C/fine pulp paper/C/B/A) and a density of 0.85 g/cm$^3$.

A thermal transfer image-receiving layer made from the coating composition having the same formulation as in the foregoing Examples was formed on one of the surface layers A of the resulting support to prepare a thermal transfer image-receiving sheet. The resulting image-receiving sheet was evaluated in the same manner as in the foregoing Examples. As a result, it had a rough feeling rated 5 and a gradation rated 4.

EXAMPLE 11

Support S-7 was laminated on each side of 60 μm thick fine pulp paper using a polyether polyol/polyisocyanate adhesive to prepare a support having a 7-layered structure (A/B/C/fine pulp paper/A/B/C) and a density of 0.86 g/cm$^3$.

A thermal transfer image-receiving layer made from the coating composition having the same formulation as in the foregoing Examples was formed on the surface layer A of the resulting support in the same manner as in Example 1 to prepare a thermal transfer image-receiving sheet. The resulting image-receiving sheet was evaluated in the same manner as in the foregoing Examples. As a result, it had a rough feeling rated 5 and a gradation rated 4.

EXAMPLE 12

Support S-9 prepared in Example 9 was laminated on each side of 60 μm thick fine pulp paper using a polyether polyol/polyisocyanate adhesive to prepare a support having a 9-layered structure (A/B/C/D/fine pulp paper/A/B/C/D) and a density of 0.89 g/cm$^3$.

A thermal transfer image-receiving layer made from the coating composition having the same formulation as in the foregoing Examples was formed on the surface layer A of the resulting support in the same manner as in Example 1 to prepare a thermal transfer image-receiving sheet. The resulting image-receiving sheet was evaluated in the same manner as in the foregoing Examples. As a result, it had a rough feeling rated 4 and a gradation rated 4.

EXAMPLE 13

(A) The polypropylene having an MI of 4 g/10 min and a melting point of from 164° to 167° C., (B) a composition comprising 55 parts of the polypropylene having an MI of 0.8 g/10 min, 10 parts of the high-density polyethylene having an MI of 1.2 g/10 min, and 35 parts of calcium carbonate having an average particle size of 1.5 μm, and (C) the same polypropylene (MI: 4 g/10 min) as (A) above were each melt-kneaded at 260° C. in separate extruders, fed to the same die, laminated in the die, and extruded into a sheet. The extruded sheet was cooled with a cooling roll to about 60° C. to obtain a laminate sheet.

The laminate sheet was heated to about 140° C. and stretched 5 times in the machine direction by using the difference in peripheral speed among plural rolls. The stretched film was again heated to about 158° C. and stretched 8.5 times in the transverse direction by means of a tenter. The resulting biaxially stretched film was subjected to annealing at 165° C., cooled to 60° C., and trimmed to obtain a support having a three-layered structure (A/B/C=3 μm/54 μm/3 μm).

Surface layer A of the resulting support had a three-dimensional center-plane average roughness (Ra) of 0.37 μm. The support had a density of 0.61 g/cm$^3$, a void volume of 48%, and a compressibility of 40% under a load of 32 kg/cm$^2$. Other properties are given in Table 3.

A thermal transfer image-receiving layer made from the coating composition having the same formulation as in the foregoing Examples was formed on surface layer A of the support in the same manner as in Example 1 to prepare a thermal transfer image-receiving sheet.

Figure 4:
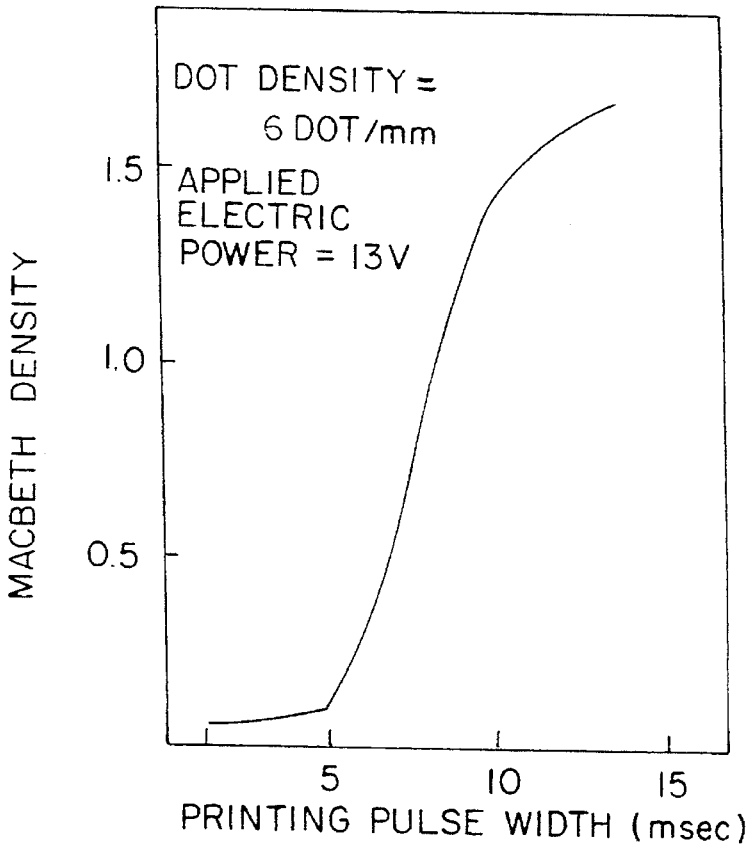
FIG. 4 is a graph of the Macbeth density of the transferred image obtained vs. the printing pulse width used in Example 13.

The resulting image-receiving sheet was printed using a printer produced by Ohkura Electric Co., Ltd. (dot density: 6 dot/mm; applied electric power: 13 V) while varying the printing pulse width from 0 to 15 msec, and the Macbeth density of the transferred image was measured. The change of the density with change of pulse width is shown in FIG. 4. The Macbeth density of the high light with a pulse width of 5 msec is shown in Table 4 below. Further, the gradation of the transferred image was evaluated in the same manner as in the foregoing Examples. The results obtained are shown in Table 4.

EXAMPLE 14

A support was prepared in the same manner as in Example 13, except for changing the composition of each layer and the aperture of the die as shown in Table 3 below.

A thermal transfer image-receiving layer made from the coating composition having the same formulation as in the foregoing Examples was formed on surface layer A of the resulting support in the same manner as in Example 13 to prepare a thermal transfer image-receiving sheet. The resulting image-receiving sheet was evaluated in the same manner as in Example 13. The results obtained are shown in Table 4.

EXAMPLE 15

A support was prepared in the same manner as in Example 13, except for providing no layer C.

A thermal transfer image-receiving layer made from the coating composition having the same formulation as in the foregoing Examples was formed on surface layer A of the resulting support in the same manner as in Example 13 to prepare a thermal transfer image-receiving sheet. The resulting image-receiving sheet was evaluated in the same manner as in Example 13. The results obtained are shown in Table 4.

COMPARATIVE EXAMPLES 2 AND 3

A thermal transfer image-receiving sheet was prepared in the same manner as in Example 13, except for using the support described in Example 2 of JP-A-3-216388 (Comparative Example 2) or the support described in Example 1 of JP-A-63- 222891 (Comparative Example 3). The resulting image-receiving sheet was evaluated in the same manner as in Example 13. The results obtained are shown in Table 4.

TABLE 3

| Example No. | Surface Layer A; PP | Base Layer B PP | Base Layer B HDPE | Base Layer B $CaCO_3$ | Back Layer C PP | Back Layer C $CaCO_3$ | Thickness (A/B/C) (μm) | Properties of Layer A Ra (μm) | Properties of Layer A Gloss (%) | Properties of Layer A λa (μm) | Properties of Layer A Bekk's Index (sec) | Properties of Support Density ($g/cm^3$) | Properties of Support Void Volume (%) | Properties of Support Compressibility (%) |
|---|---|---|---|---|---|---|---|---|---|---|---|---|---|---|
| 13 | 100 | 55 | 10 | 35 | 100 | — | 3/54/3 | 0.37 | 93 | 66.8 | 13800 | 0.61 | 48 | 40 |
| 14 | 100 | 75 | 5 | 20 | 100 | — | 3/54/3 | 0.44 | 94 | 70.5 | 14500 | 0.62 | 40 | 38 |
| 15 | 100 | 55 | 10 | 35 | — | — | 3/57/— | 0.43 | 94 | 66.2 | 14900 | 0.60 | 49 | 41 |
| Compar. Example 2 | Example 2 of JP-A-3-216386 | | | | | | 1/58/1 | 0.39 | 86 | 67.3 | 4500 | 0.68 | 29 | 26 |
| Compar. Example 3 | Example 1 of JP-A-63-222891 | | | | | | | 0.45 | 17 | 112.5 | 800 | 0.76 | 31 | 24 |

TABLE 4

| Example No. | Macbeth Density* | Gradation |
|---|---|---|
| 13 | 0.26 | 5 |
| 14 | 0.24 | 5 |
| 15 | 0.25 | 5 |
| Compar. Example 2 | 0.14 | 4 |
| Compar. Example 3 | 0.10 | 2 |

Note:
*Pulse width: 5 msec.

EXAMPLE 16

(A) The polypropylene having an MI of 4 g/10 min and a melting point of from 164° to 167° C., (B) a composition comprising 55 parts of the polypropylene having an MI of 0.8 g/10 min, 10 parts of the high-density polyethylene having an MI of 1.2 g/10 min, and 35 parts of calcium carbonate having an average particle size of 1.5 μm, and (C) the polypropylene having an MI of 4 g/10 min were each melt-kneaded at 260° C. in separate extruders, fed to the same die, laminated in the die, and extruded into a sheet. The extruded sheet was cooled with a cooling roll to about 60° C. to obtain a laminate sheet having the structure of A/B/C. The laminate sheet was heated to about 140° C. and stretched 5 times in the machine direction by using the difference in peripheral speed among plural rolls.

(D) A composition comprising 55 parts of the polypropylene having an MI of 4 g/10 min and 45 parts of calcium carbonate having an average particle size of 1.5 μm was melt-kneaded in an extruder and extruded into a sheet. The resulting extruded sheet D was laminated on layer C of the above-prepared three-layered 5-fold stretched sheet. The resulting laminate was cooled to 60° C., re-heated to 160° C. and stretched 8.5 times in the transverse direction by means of a tenter. The resulting biaxially stretched laminate film was subjected to annealing at 165° C., cooled to 60° C., and trimmed to obtain a support having a 4-layered structure (A/B/C/D=1 μm/58 μm/1 μm/20 μm).

Surface layer A of the resulting support had a three-dimensional center-plane average roughness (Ra) of 0.43 μm. The support had a density of 0.68 $g/cm^3$, a void volume of 44%, and a compressibility of 38% under a load of 32 $kg/cm^2$.

A thermal transfer image-receiving layer made from the coating composition having the same formulation as in the foregoing Examples was formed on surface layer A of the support in the same manner as in Example 13 to prepare a thermal transfer image-receiving sheet.

When printed in the same manner as in Example 13, the image-receiving sheet formed an image having satisfactory gradation rated as 4 and a Macbeth density of 0.24.

EXAMPLE 17

The support prepared in Example 13 was laminated on each side of 60 μm thick fine pulp paper using a polyether polyol/polyisocyanate adhesive, with each surface layer A outermost to prepare a support having a 7-layered structure (A/B/C/fine pulp paper/C/B/A) and a density of 0.76 $g/cm^2$.

A thermal transfer image-receiving layer made from the coating composition having the same formulation as in the foregoing Examples was formed on one of the surface layers A of the resulting support in the same manner as in Example 13 to prepare a thermal transfer image-receiving sheet. When evaluated in the same manner as in Example 16, the resulting image-receiving sheet provided an image with satisfactory gradation rated as 5 and a Macbeth density of 0.26.

As described and demonstrated above, the thermal transfer image-receiving sheet according to the present invention, in which the surface layer of the support thereof is characterized by a spatial average wavelength (λa) of not more than 100 μm, provides an image excellent in gloss and free from any rough feeling.

Further, the image-receiving sheet of the present invention exhibits an excellent cushioning effect because of the number of microvoids contained in the support so that a clear image having a high density can be obtained at high sensitivity even with a reduced printing energy.

While the invention has been described in detail and with reference to specific examples thereof, it will be apparent to one skilled in the art that various changes and modifications can be made therein without departing from the spirit and scope thereof.

What is claimed is:

1. A thermal transfer image-receiving sheet comprising (1) a support comprising (B) a base layer comprising a biaxially stretched microporous film of a thermoplastic resin containing from 10 to 45% by weight of an inorganic fine powder and (A) a surface layer comprising a biaxially stretched film of a thermoplastic resin having a three-dimensional center-plane average roughness Ra of not more than 0.5 μm, said surface layer (A) having a spatial average wavelength λa defined by the equation: $\lambda a=2\pi Ra/\Delta a$, wherein Ra is the three-dimensional center-plane average roughness and Δa is the three-dimensional average slope, of not more than 100 μm and a gloss of not less than 93% measured at 75° according to JIS P-8142 and (2) an image-receiving layer provided on the surface of said surface layer (A).

2. A thermal transfer image-receiving sheet as claimed in claim 1, wherein said surface layer (A) has a Bekk's index of from 11,000 to 20,000 sec.

3. A thermal transfer image-receiving sheet as claimed in claim 1, wherein said surface layer (A) has a three-dimensional center-plane average roughness of from 0.30 to 0.45 μm and a spatial average wavelength (λa) of from 55 to 75 μm.

4. A thermal transfer image-receiving sheet as claimed in claim 1, wherein said support has a void volume of from 15 to 60%.

5. A thermal transfer image-receiving sheet as claimed in claim 1, wherein said support has a void volume of from 18 to 45%.

6. A thermal transfer image-receiving sheet as claimed in claim 1, wherein said thermoplastic resin is a propylene-based resin.

7. A thermal transfer image-receiving sheet as claimed in claim 1, wherein said support has a density of not more than 0.78 $g/cm^3$ and a compressibility of from 36 to 55% against a compression load of 32 $kg/cm^2$.

8. A thermal transfer image-receiving sheet as claimed in claim 1, wherein said support has a density of not less than 0.55 $g/cm^3$ but less than 0.70 $g/cm^2$.

* * * * *